US006216377B1

(12) United States Patent
Painsith

(10) Patent No.: US 6,216,377 B1
(45) Date of Patent: Apr. 17, 2001

(54) DISPLAY FRAME FOR PHOTOGRAPHS AND THE LIKE AND TYPICALLY CREDIT CARD-SIZED

(75) Inventor: Hermann K. Painsith, Klagenfurt (AT)

(73) Assignee: PIK U.S.A. Inc., Carson City, NV (US)

( * ) Notice: Subject to any disclaimer, the term of this patent is extended or adjusted under 35 U.S.C. 154(b) by 0 days.

(21) Appl. No.: 09/234,872

(22) Filed: Jan. 21, 1999

Related U.S. Application Data

(63) Continuation-in-part of application No. 08/647,246, filed on May 9, 1996, now abandoned.

(51) Int. Cl.[7] ..... A47G 1/16
(52) U.S. Cl. ..... 40/750; 40/753; 40/754
(58) Field of Search ..... 40/611, 649, 654.01, 40/746, 748, 750, 753, 755, 754, 757, 765, 775, 791, 120; 248/222.51, 291.1, 351, 447, 462

(56) References Cited

U.S. PATENT DOCUMENTS

| | | | | |
|---|---|---|---|---|
| 896,231 | * | 8/1908 | Mulkey | 40/755 X |
| 1,904,318 | * | 4/1933 | Lehere | 40/791 |
| 2,003,824 | * | 6/1935 | Cavalero | 40/748 |
| 2,419,823 | * | 4/1947 | Cross et al. | 40/753 |
| 2,647,834 | * | 8/1953 | Rabkin et al. | 40/753 X |
| 3,545,115 | * | 12/1970 | Nichols | 40/750 |
| 3,996,683 | * | 12/1976 | Hanke | 40/701 |
| 4,268,984 | * | 5/1981 | Taylor | 40/735 X |
| 4,534,185 | * | 8/1985 | Berry et al. | 40/721 X |
| 4,622,767 | * | 11/1986 | Sullivan | 40/753 X |
| 4,750,282 | * | 6/1988 | Zennedjian | 40/611 X |
| 4,884,353 | * | 12/1989 | Taylor | 40/649 X |
| 4,936,033 | * | 6/1990 | Lacko | 40/757 X |
| 4,979,323 | * | 12/1990 | Wenkman et al. | 40/746 |
| 5,581,925 | * | 12/1996 | Snoke et al. | 40/791 |

* cited by examiner

*Primary Examiner*—Brian K. Green
(74) *Attorney, Agent, or Firm*—Marvin S. Towsend

(57) ABSTRACT

A credit card-size plastics display frame defines a front rectangular opening and coplanar side grooves peripherally around this opening for receiving a photograph and a protective window in front thereof, the window being usable as a template to cut an appropriately sized photograph from a standard size picture for insertion in the display frame. The photograph and the window are installed in the frame by front loading through the rectangular opening. The rear wall of the frame defines panels which can be selectively, and reversibly, folded back to form a foot member to allow the frame to stand on a horizontal surface. A diamond-shaped cutout is defined in the rear wall to allow the display frame to be hung on a wall with a nail and to facilitate the removal of the photograph and window from the frame. The display frame is characterized by its universal credit card dimensions, the snap fit front loading mounting of the photograph and window, the reversibly extendible support stands, by the diamond-shaped cutout, and the window which also acts as a template to down-size a standard picture to the required dimensions for the display frame.

5 Claims, 5 Drawing Sheets

DISPLAY FRAME FOR PHOTOGRAPHS AND THE LIKE AND TYPICALLY CREDIT CARD-SIZED

This application is a continuation-in-part of U.S. Ser. No. 08/647,246 filed May 9, 1996, which is now abandoned.

BACKGROUND OF THE INVENTION

1. Field of the Invention

The present invention relates to display frames for displaying, for instance, photographs and, more particularly, to a wallet-sized front-loading display frame, typically substantially of credit card dimensions.

2. Description of the Prior Art

Frames for displaying pictures and the like are well known in the art. For instance, U.S. Pat. No. 2,647,834 issued on Aug. 4, 1953 to Rabkin et al. discloses a frame 10 for a photographic plate 14 with peripheral side grooves being defined in the frame 10 for receiving the peripheral edges of the plate 14. The photographic plate 14 is rear-loaded into the frame 10 and the backing member 24 is provided with tear supports 34 and 36 which can be unfolded from a position coplanar with the frame 10 to a deployed position wherein the supports 34 and 36 extend at an angle with respect to the frame 10 for use as a foot member supporting the frame 10 at an angle atop a horizontal surface.

U.S. Pat. No. 4,379,373 issued on Apr. 12, 1983 to Transport discloses a stamped planar picture frame which is foldable so as to retain therein a picture and which is provided with a collapsible easel 29 for displaying the frame and the picture carried therein at an angle on a horizontal surface. Notches 20 and 22 are defined on the back of the picture frame to allow for the photograph of the like to be inserted therein substantially along the plane of the picture frame and into the vertical grooves defined in the picture frame.

U.S. Pat. No. 4,885,854 issued on Dec. 12, 1989 to Brandes discloses a picture frame formed from a unitary blank and adapted to be folded for retaining therein a photograph while permitting for the display thereof at an angle on a horizontal surface. The picture can be positioned in the assembled frame by temporarily disconnecting and unfolding the rear panel 15 thereof.

U.S. Pat. No. 5,359,794 issued on Nov. 1, 1994 to Wood discloses a further picture frame formed from a blank of a flexible sheet material which is scored and shaped to provide, when folded, a photograph-receiving frame defining a slot 52 through which the picture can be inserted in the frame along a plane substantially coplanar therewith with the picture being then retained in position in the frame by the pocket formed by the raised adhesive strips 50 and 50'.

U.S. Pat. No. 5,361,521 issued on Nov. 8, 1994 to Burtch discloses a display frame for baseball cards and the like which is made from a blank sheet and which, when assembled, forms a display frame provided with an erectable support 44 to enable the display frame to stand up on a support surface. The display frame defines a pocket 36 such that a baseball card 42 can be inserted therein through the upper opening defined by the display frame's structure and, more particularly, by its removable panel 24.

U.S. Pat. No. 4,934,078 issued on Jun. 19, 1990 to Sloot discloses a planar erectable picture frame having a front transparent window 20 with a slit 26 being defined on the backing member of the picture frame for allowing a photograph to be inserted inside the picture frame and opposite the window 20. An outer sheet of the backing layer is provided with a support stand 16 to allow the picture frame to be displayed at an angle on a horizontal support surface.

U.S. Pat. No. 4,100,690 issued on Jul. 18, 1978 to O'Neill discloses a folded structure of foldable sheet material formed of two or more members and held together entirely by the inter-engagement of tabs and slots provided on the members. The tabs and slots are positioned such that the assembled structure defines a recessed central region surrounded by a border portion having an overhanging lip such that pictures, postcards and the like can be displayed in the folded structure.

U.S. Pat. No. 3,214,855 issued on Nov. 1, 1965 to Winkler et al. discloses a cardboard blank which can be folded to form a picture frame.

SUMMARY OF THE INVENTION

It is therefore an aim of the present invention to provide a novel display frame for photographs and the like.

It is also an aim of the present invention to provide a display frame which is substantially of credit card dimensions such as to be universally transportable in wallets and the like.

It is a further aim of the present invention to provide a display frame in which the photograph can be front-loaded into position therein.

It is a still further aim of the present invention to provide a display frame in which the photograph is front-loaded therein, followed by the front-loading of a transparent protective window in front of the photograph.

It is a still further aim of the present invention to provide a display frame provided with a template for allowing a photograph to be cut to an appropriate size for insertion in the display frame.

It is a still further aim of the present invention to provide a display frame in which the transparent window can be used as the aforementioned template.

It is a still further aim of the present invention to provide a display frame provided with integral reversibly foldable support stands for selectively permitting the display frame and the photograph carried therein to stand atop a horizontal surface while allowing the support stands to be returned to a position coplanar with the display frame, for instance, for subsequent storage in a wallet or the like.

Therefore, in accordance with the present invention, there is provided a display frame adapted to receive therein a sheet-like article for the display thereof, comprising attachment means for retaining the article on said display frame, viewing means for allowing at least part of the article to be viewed when mounted to said display frame, said display frame having a length of 86 mm±5 mm and a width of 54 mm±5 mm.

Also in accordance with the present invention, there is provided a method of installing a sheet-like article in a display frame for the display of said article, comprising the steps of providing a display frame defining a front opening and mounting the article to said display frame by front-loading said article through said front opening.

Further in accordance with the present invention, there is provided a method of cutting down a sheet-like article to a size suitable for installation in a display frame for in a display frame, comprising the steps of providing a display frame, a sheet-like article and a template means; determining with said template means a section of said article intended to be installed in the display, said section having boundaries suitable for a proper fit thereof in said display frame; removing said section from said article; and installing said section in the display frame for the display thereof.

Still further in accordance with the present invention, there is provided a display frame adapted to receive therein a sheet-like article for the display thereof, comprising attachment means for retaining the article on said display frame, front opening means at a front side of said display article, said front opening means allowing at least part of the article to be viewed when mounted to said display frame, said front opening means and said attachment means cooperating for allowing the article to be mounted to said display frame by front-loading thereof through said front opening means.

Still further in accordance with the present invention, there is provided a display frame adapted to receive therein a sheet-like article for the display thereof, comprising attachment means for retaining the article on said display frame, viewing means for allowing at least part of the article to be viewed when mounted to said display frame, and template means adapted to define the limits of the article when cut from a second larger article such that the article is of dimensions appropriate for installation in said display frame.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENT

Figure 1:
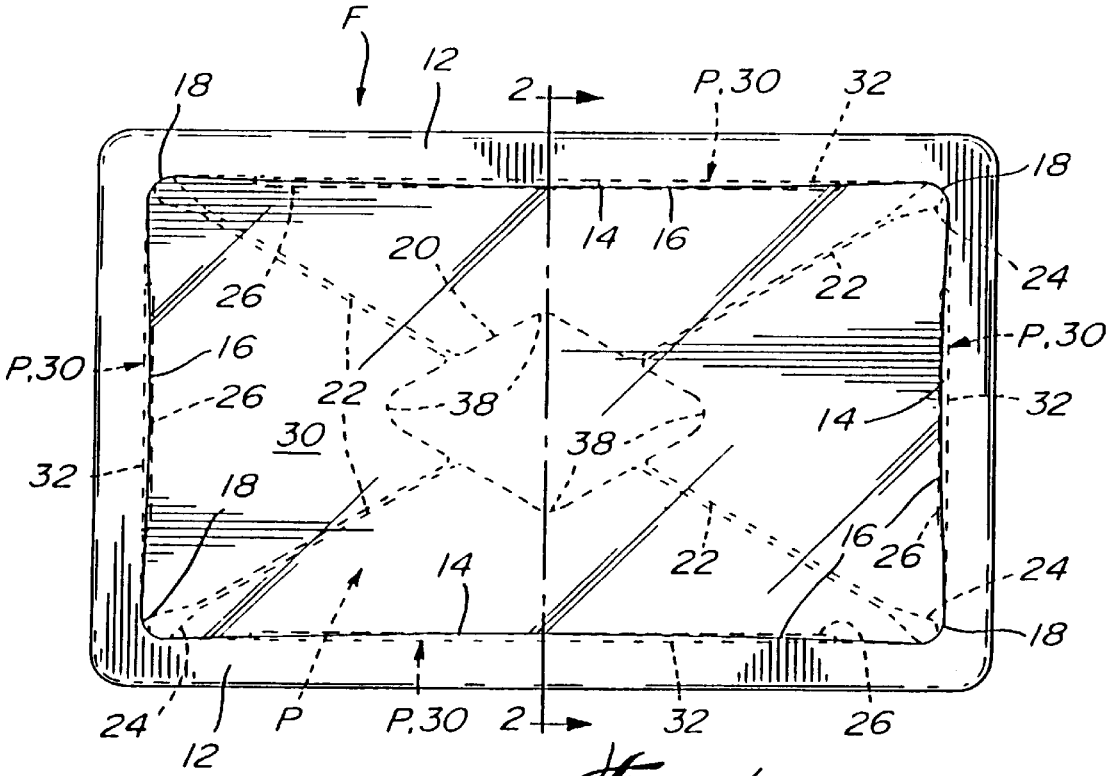
FIG. 1 is a front elevational view of a display frame for photographs and the like in accordance with the present invention.

With reference to the drawings and, more particularly, to FIG. 1, there is illustrated a novel display frame F which is typically made of a plastics material and by way of an injection molding process. The display frame F comprises a substantially rectangular rear wall 10 which peripherally defines a slightly forwardly projecting frame-shaped rim 12 (see FIG. 2) integral with the rear wall 10 and defining at the front end thereof an inwardly projecting peripheral lip 14. As seen in FIG. 1, on each front side of the frame-shaped rim 12, the lip defines a slightly convex inner edge 16 with each convex inner edge 16 extending between a pair of successive inner rounded corners 18 defined by the rim 12. The purpose of these convex inner edges 16 will be described in detail hereinafter.

The rear wall 10 defines a central diamond-shaped cutout 20 and four slots 22 extending diagonally outwardly therefrom and defining enlarged free ends 24. The rear wall 10 also defines near the outer edges thereof four linear slots 26 which run parallel to respective sides of the rear wall 10. The linear slots 26 have a dual function wherein the linear slots 26 act as score lines for facilitating the folding or deployment of support legs of the display frame F which will be described in detail hereinafter, and further act as undercuts for use in the injection molding process.

Figure 2:
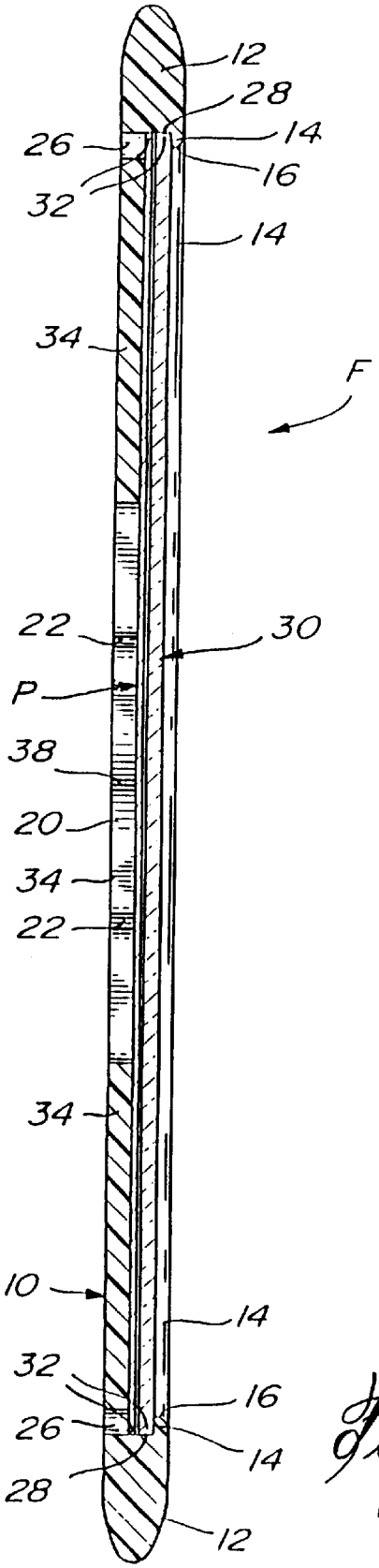
FIG. 2 is an enlarged vertical cross-sectional view of the display frame taken along line 2—2 of FIG. 1.

The rear wall 10, the rim 12 and the lip 14 define an inwardly facing peripheral shallow channel 28, as best seen in FIG. 2, which is adapted to receive the peripheral edges of a photograph P, or the like, and a protective window 30 typically made of a substantially flexible transparent plastics material.

One of the objects of the present invention is to provide a display frame which can be easily carried in wallets and the like and, more particularly, within integral pockets or plastic sleeves defined in such object-carrying articles. Accordingly, the outer dimensions of the display frame F are preferably, but not limitatively, similar to those of a credit card, whereby the display frame F might have a length of 86 mm±5 mm and a width of 54 mm±5 mm. Furthermore, the display frame F is made very thin such as to fit in the aforementioned credit card-receiving pockets and sleeves provided in wallets and the like.

Therefore, the display frame F defines a front substantially rectangular opening inwardly of the lip 14 such that the coplanar side channels 28 which extend peripherally behind this opening and the lip 14 can receive the outside edges of the photograph P and of the window 30.

Importantly, the photograph P and the window 30 are substantially rectangular while defining rounded corners and are sized such that their rounded corners are positioned in the display frame F substantially opposite the inner corners 18 and even slightly inwardly thereof. The photograph P and the window 30 both define between their respective rounded corners rectilinear edges 32 with the photograph P and the window 30 being sized such that their rectilinear edges 32 run at least partly behind the convex lips 14, as seen in broken lines in FIG. 1. The flexibility of both the photograph P and the window 30 allows the same to be front-loaded into the display frame F with a snap-like fit, and this is facilitated by the rounded corners of the photograph P and of the window 30 extending substantially opposite the inner corners 18 of the lip 14, and even slightly inwardly thereof, such as to clear the corners whereas the rectilinear edges 32 of the photograph P and window 30 can be easily snapped into engagement behind the convex inner edges 16 of the lip 14 and thus into the channels 28, the portions of the lips 14 overlapping the photograph P and window retaining these components in position in the display frame F.

It is noted that once the photograph P has been front-loaded into position in the display frame F, the transparent cover sheet or window 30 is positioned in a same way over the photograph P, that is by front-loading. It might also be possible to install both the photograph P and the window 30 in a single step.

Preferably, the window 30 is used as a template in order to cut an appropriately sized section of a photograph for insertion in the display frame F. The transparency of the window 30 further allows the original photograph and, more particularly, its section being cutout therefrom to be visible thereby ensuring that the proper section of the original photograph will be removed therefrom for subsequent use as the above-described photograph P within the display frame F of the present invention.

Obviously, the present display frame F can be of larger dimensions than those of a credit card such as to accommodate standard sized pictures (e.g., 3½"×5", 4"×6", 5"×7", 8"×10, 8"×12", etc.) or other sheet-like articles of different sizes worthy of display.

Figure 3:
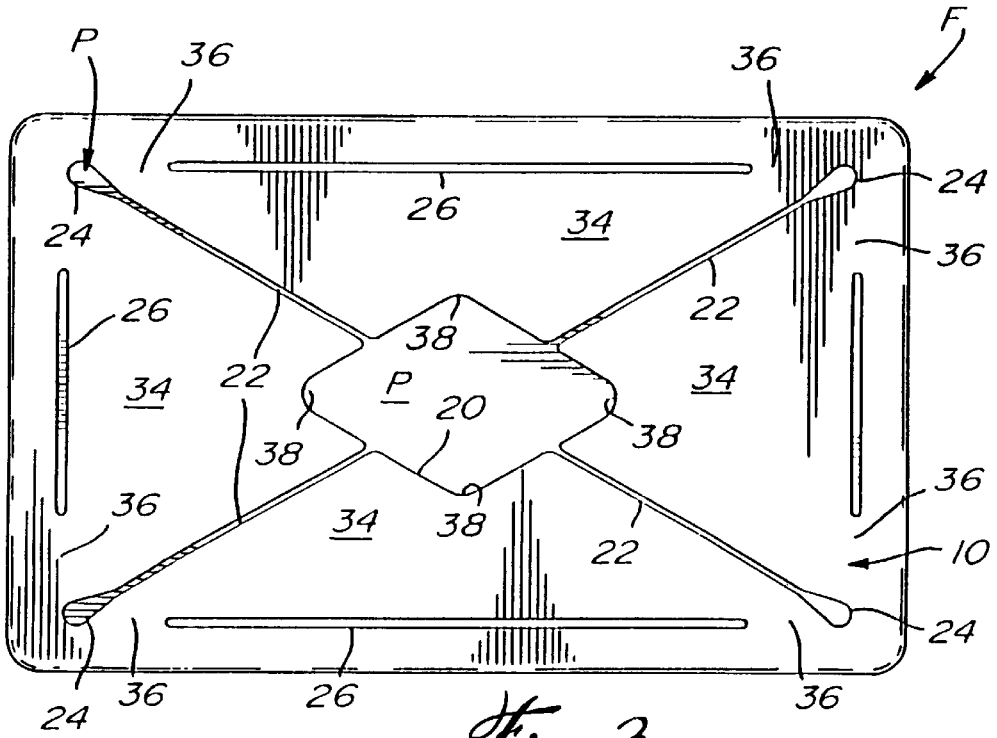
FIG. 3 is a rear elevational view of the display frame of FIG. 1.
Figure 4:
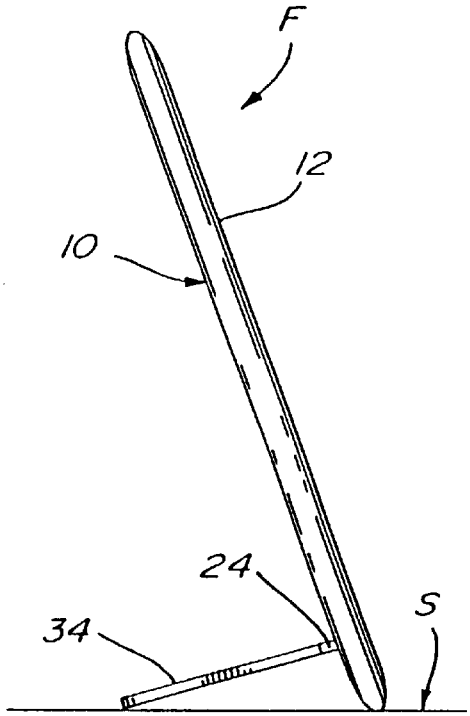
FIG. 4 is a side elevational view showing the display frame of FIG. 1 in an alternate position thereof wherein a support stand is shown in a deployed position for allowing the display frame to stand on a horizontal support surface.

Now referring generally to FIG. 3, the rear wall 10 defines four substantially triangular panel sections 34 each extending basically between a pair of successive diagonal slots 22 and a respective linear slot 26. The panel sections 34 remain attached to the rear wall 10 in view of the fact that each linear slot 26 does not reach the enlarged ends 24 of the two successive diagonal slots 22 between which such linear slot 26 extends. The linear slot 26 is thus spaced apart at each of the ends thereof from a respective enlarged end 24 of the diagonal slot 22 by approximately 8 mm of rear wall material. These portions of the rear wall 10 which extend between the ends of the linear slots 26 and the enlarged ends 24 of the diagonal slots 22 are identified by reference numeral 36 and functionally constitute hinges between the triangular panel sections 34 and the remainder of the rear wall 10, as described hereinbelow. Indeed, a selected one of the panel sections 34 can be pulled away from the plane of the display frame F and thus folded back so as to act as a foot member or stand which allows the display frame F to be supported at an angle on a horizontal surface S, as seen in FIG. 4. The rear wall 10 and its triangular panel sections 34 are designed such that the panel sections can be reversibly and repeatedly pivoted about the hinges 36 between the extended stand position thereof illustrated in FIG. 4 and the retracted position thereof of FIGS. 1 to 3.

With regards to the pivotable triangular panel sections 34, it is noted that the type of plastic used therefor and also for the rear wall 10 must have a certain resistance and, more particularly, a required flexibility in order to allow for numerous bends and deployments thereof without breaking at the hinges 36. On the other hand, the plastic has to be rigid enough that after bending, the panel sections 34 will remain in the selected, i.e. expanded or retracted, position thereof. Possible plastics material which are presently but not limitatively contemplated are polypropylene (PP), styrene/acrylonitrile copolymer modified with butadiene rubber (ABS) or modified with acrylate elastomer (SAN), high impact polystyrene (SB), polyacetal (POM), polyamide (PA), i.e. nylon resins, etc. All of these materials can also be reinforced. Furthermore, the plastic which will be selected to fulfill the above-mentioned physical requirements can also be generally transparent in order to offer more coloring possibilities.

Regarding the hinges 36 and the related linear slots 26 and enlarged ends 24, it is noted that the linear slots 26 are provided in order to reduce the effort required for bending the triangular panel sections 34 and also in order to assist the injection molding process. Indeed, the linear slots (approximately 0.8 mm wide) extending between the hinges 36 permit the formation of the undercut (lip) located at the front of the display frame F and used to mount the photograph P and the window 30 to the frame F. Indeed, a rear movable mold part of the injection molding tool defines rectangular forward ribs which form the linear slots 26 while extending forwardly up to the rear surfaces of the lips 14 with a fixed front mold part defining the slightly curved configuration of the inner edges 16 of the lips 14. It is these undercuts or lips 14 which allow for the easy front-loading of the photograph P and window 30 through the front of the frame F by defining a curve (see inner edges 16 in FIG. 1) having a large radius which peaks at about 0.5 mm in height at the middle of the frame F and which reduces gradually to zero at the inner corners 18. This basically allows for the corners of the photograph P and of the window 30 to be front-loaded substantially without bending in the display frame F with their linear edges being snapped into engagement behind the undercuts or lips 14.

The diamond-shaped cutout 20 defined in the rear wall 10 defines rounded apexes 38 which can be used for hanging the display frame F on a nail installed in a wall. Furthermore, the cutout 20 also facilitates the removal of the window 30 and of the photograph P from the display frame F by simply pushing on the photograph P through the cutout 20.

Accordingly, the features of the display frame F which are of interest reside in the universal credit card dimensions thereof; the front-loading of the photograph P in the display frame F, including the method of installing the photograph P and the window 30 in the display frame F by front-loading and with a snap-fit; the reversibly extendible panel sections 34 which act as support stands for allowing the display frame F to be supported on a horizontal surface, either along its horizontal or vertical orientation; the diamond-shaped cutout 20 defined in the rear wall 10 for allowing the display frame F to be hung on a wall and to facilitate the removal from the display frame F of the photograph P and of the window 30; and the use of the window 30 as a template to allow the user to cut a larger picture to a size appropriate for the present display frame F, i.e. the size of the illustrated photograph P, while allowing the user to clearly view the contents of the portion of the standard size picture which is being cut for the purpose of installation in the display frame F.

Figure 5:
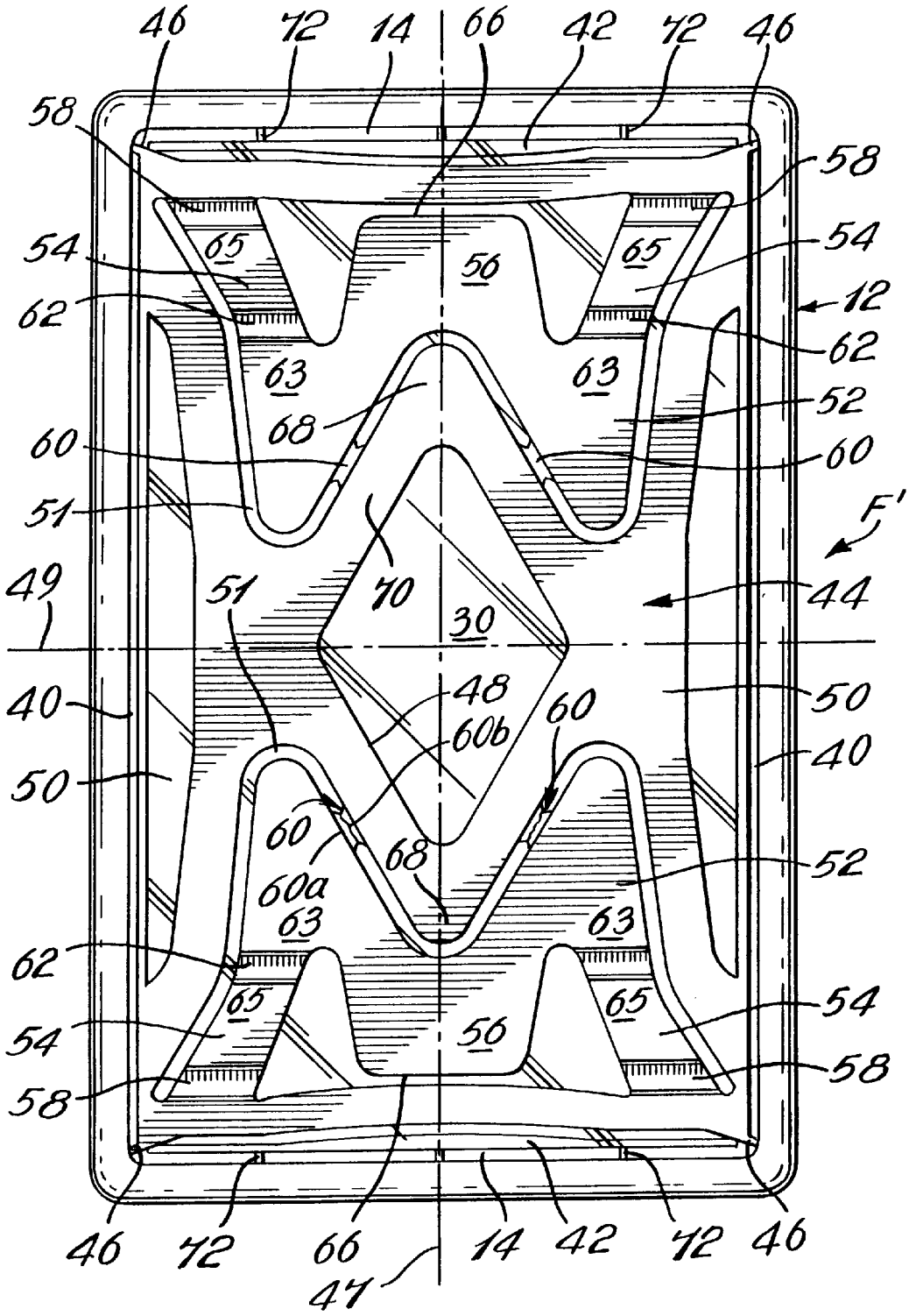
FIG. 5 is a rear elevational view of a display frame in accordance with a second embodiment of the present invention.

FIG. 5 illustrates a second embodiment of the present invention having a different rear wall configuration. More specifically, according to this embodiment, the rectangular rear wall 10' defines two linear peripheral grooves 40 extending along a major portion of the longer sides of the display frame F'. The rear wall 10' further defines two peripheral openings 42 extending along a major portion of the shorter sides of the display frame F'. The linear peripheral grooves 40 along with the peripheral openings 42 form a central rear wall portion 44 which cooperates with the lips 14 for retaining the window 30 and a photograph (not shown) in place within the display frame F'. The central rear wall portion 44 is integrally connected along the longer sides thereof to the frame-shaped rim 12. Furthermore, an integral connecting member 46 extends diagonally from each corner of the central rear wall portion 44 to strengthen the attachment thereof to the frame-shaped rim 12.

The central rear wall portion 44 defines a central diamond-shaped cutout 48 through which one may push on the photograph (not shown) to remove the same from the display frame F', as explained hereinbefore with respect to the first described embodiment. The central rear wall portion 44 also defines two elongated openings 50 symmetrically disposed with respect to a longitudinal median axis of the display frame F'. Cutouts 51 are defined in the central wall portion 44 so as to form a pair of pivotable integral support stands 52. The support stand 52 are symmetrically disposed with respect to a transversal median axis of the display frame F'.

According to the illustrated embodiment, the support stands 52 have a M-shaped configuration. Each support stand 52 includes two external legs 54 connected to each other through a central tab or flap 56. Each external leg 54 is connected to the central rear wall portion 44 via a first live hinge 58 and a frangible connection 60 extending through the cutout 51. Accordingly, to pivot a selected one of the support stand 52 about its first live hinges 58, the frangible connections 60 thereof must first be broken into two distinct portions 60*a* and 60*b*. This could be accomplished by simply pulling on the selected support stand 52 to pivot it away from the plane of the display frame F'. As will be explained hereinafter, the broken portions 60*a* and 60*b* will cooperate to retain the support stand 52 in a non-functional retracted position thereof. A second live hinge 62 is defined in each external legs 54 to allow articulation thereof. The second live hinges 62 divide the external legs 54 into a first portion 63 and a second portion 65.

Figure 7:
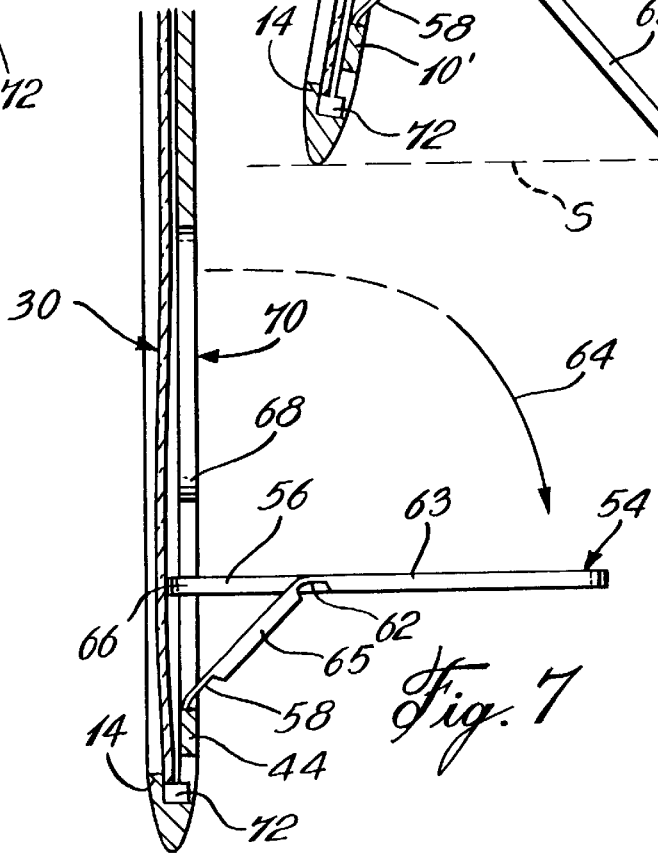
FIG. 7 is an enlarged vertical cross-sectional view of a portion of the display frame of FIG. 5 wherein the support stand of FIG. 6 is in the process of being deployed to an extended stand position thereof.

As seen in FIG. 7, once the frangible connections 60 of a selected one of the support stands 52 have been ruptured, the selected support stand 52 is allowed to be pivoted away from the plane of the display frame F' about the first live hinges 58 thereof. During the first phase of the pivotal movement in the direction of arrow 64, the selected support stand 52 will essentially only pivot about the first live hinge 58 thereof. However, continuous pulling action on the selected support stand 52 above the second live hinges 62 thereof will eventually cause the support stand 52 to also pivot about the second live hinges 62 and, thus, cause the external legs 54 to be folded. Accordingly, the first portion 63 of the external legs 54 will be pivoted away from the plane of the display frame F'. Since the central flap 56 is connected to respective first portions 63 of the legs 54 and is disposed on opposite side of the pivot axis extending through the second live hinges 62 of the selected support stand 52, the central flap 56 will be moved in the opposite direction, i.e. towards the plane of the display frame F'. At a certain point, as illustrated in FIG. 7, the distal edge 66 of the central flap 56 will engage the photograph (not shown) and cause the same to bent with the window 30. From this position to the position illustrated in FIG. 8, the central flap 56 acts as a locking member to overcome the resiliency of the external legs 54 at the second live hinges 62 thereof. In other words, past the position illustrated in FIG. 7, the biasing force of the second live hinges 62 will urge the central flap 52 against the photograph (not shown), thereby preventing the second leg portion 63 from being pivoted towards their original position.

Figure 8:
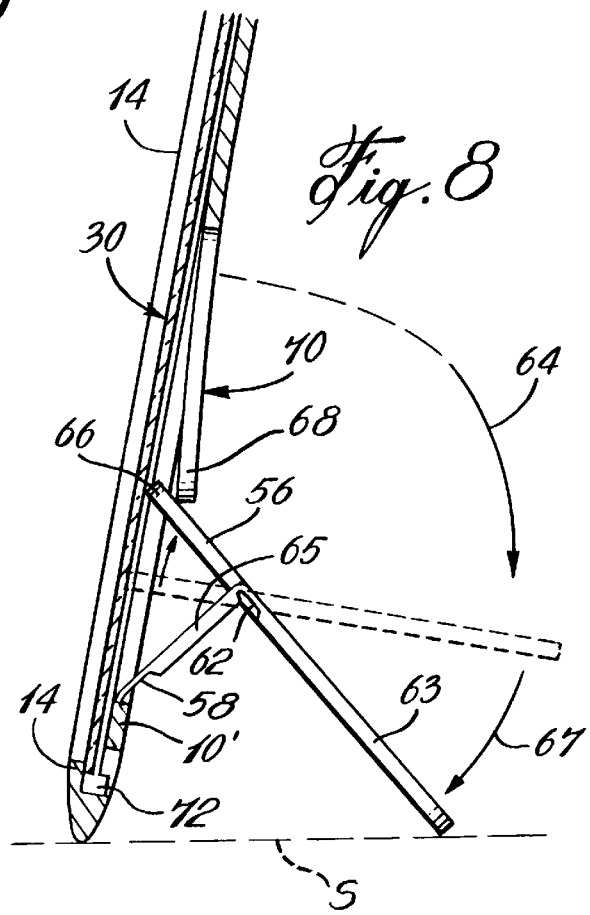
FIG. 8 is an enlarged vertical cross-sectional view of a portion of the display frame of FIG. 5 illustrating the support stand in the extended stand position thereof.
Figure 9:
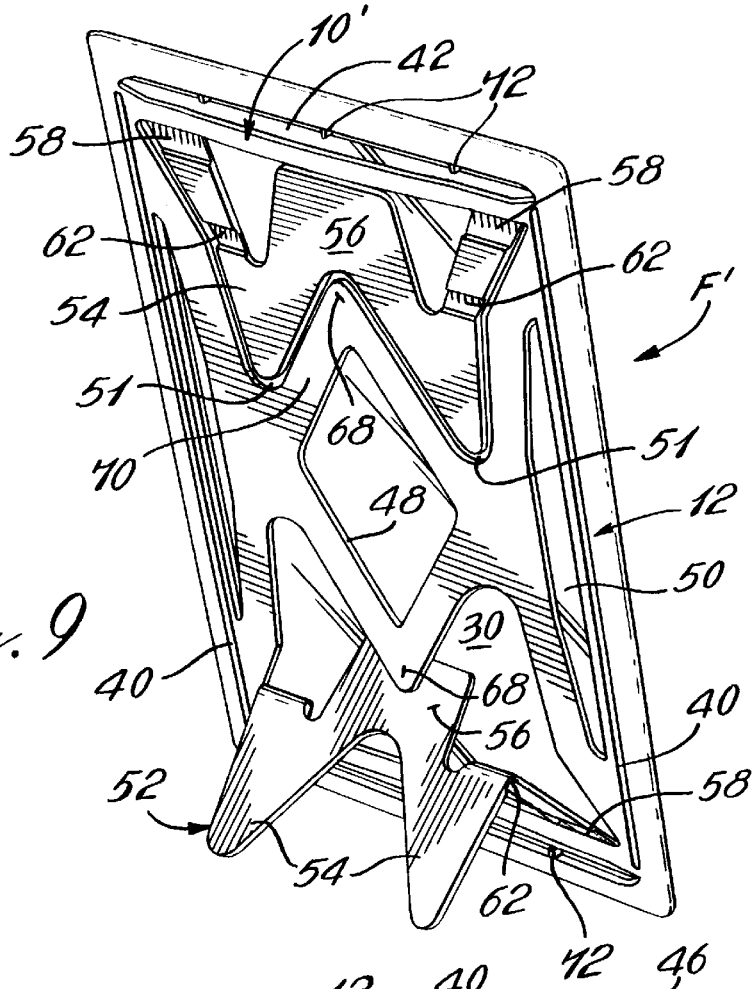
FIG. 9 is a rear perspective view of the display frame of FIG. 5 shown with one support stand deployed to support the display frame at an angle on a horizontal surface with the longitudinal axis of the display frame transversal to the support surface.

Further pivot of the first leg portions 63 of the selected support stand 52 about respective second live hinges 62 in the direction indicated by arrow 66 in FIG. 8 will bring the central flap 56 in engagement between the photograph (not shown) and one apex 68 of a diamond-shaped rear wall portion extending between the two support stands 52 about the central diamond-shaped cutout 48. In this position, the first leg portions 63 of the selected support stand 52 will act as a support foot for supporting the display frame F' on a horizontal surface F'. As seen in FIG. 8, the central flap 56 will push on the apex 68 thereby causing the same to flex away from the plane of the display frame F'. As the apex 68 is resilient, it will tend to recover the original position thereof, thereby further urging the support flap 56 against the photograph (not shown). Accordingly, the friction between the apex 68, the central flap 56 and the photograph (not shown) will help maintaining the selected support stand 52 in its functional stand position to support the display frame F' along a short orientation thereof, as seen in FIGS. 8 and 9. It is noted that the biasing force of the first and second pairs of live hinges 58 and 62 will also prevent the selected support stand 52 from being pivoted back to its original retracted position while supporting the display frame F' on a horizontal surface S.

Figure 6:
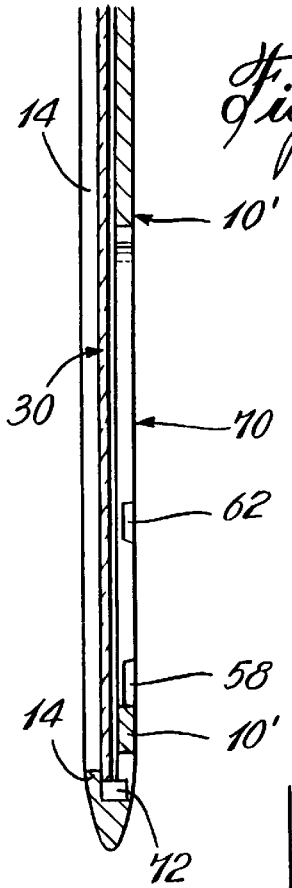
FIG. 6 is an enlarged vertical cross-sectional view of a portion of the display frame of FIG. 5 wherein a support stand is shown in a retracted position thereof.
Figure 10:
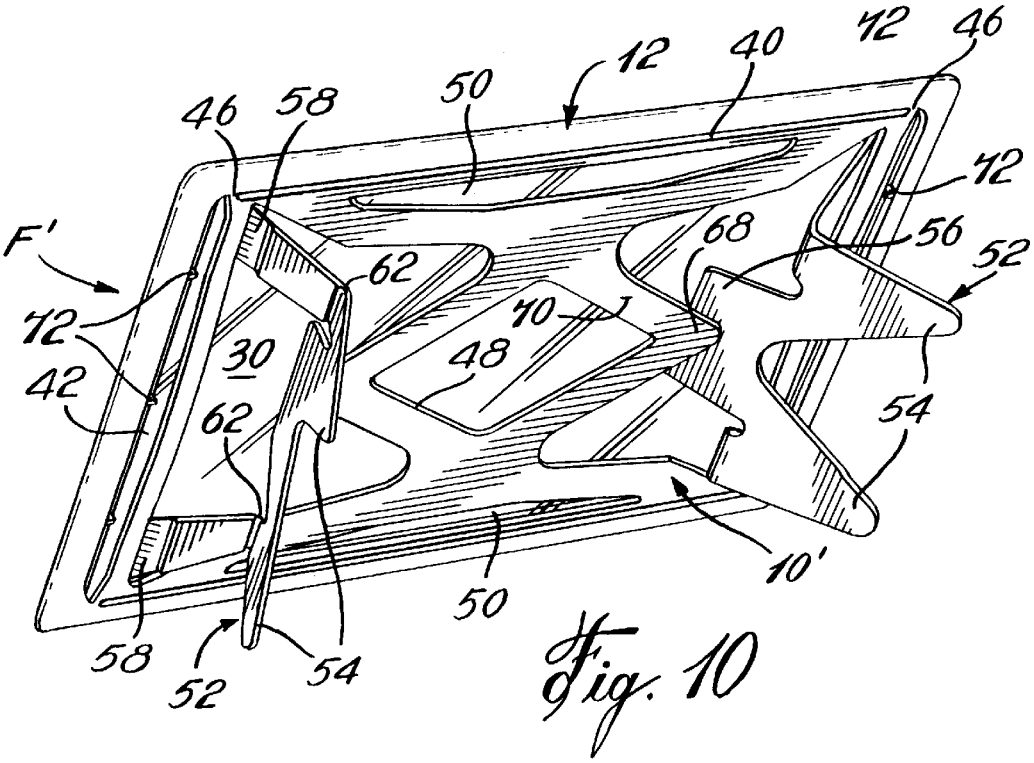
FIG. 10 is a rear perspective view of the display frame of FIG. 5 shown with two support stands deployed to support the display frame at an angle on a horizontal support surface with the longitudinal axis of the display frame parallel to the support surface.

The first and second pairs of live hinges 58 and 62 are designed such that the support stands 52 can be reversibly and repeatedly pivoted between the stand position illustrated in FIGS. 8 to 10 and the retracted position thereof of FIGS. 5 and 6. When a selected support stand 52 is pivoted back to its retracted position, the associated broken portions 60*a* and 60*b* will snap into engagement so as to retain the selected support stand 52 in the plane of the display frame. However, if it is subsequently desired to displace the selected support stand 52 to the stand position thereof, the friction between associated broken portions 60*a* and 60*b* can be readily overcome by simply pulling on the selected stand 52.

According to another embodiment of the present invention, the frangible connections 60 could be replaced by snap-like fit cooperating members.

As seen in FIG. 10, the two support stands 52, which are symmetrically disposed relative to the median transversal axis of the display frame F', may be both deployed to support the display frame F' along the long orientation thereof instead of the short orientation thereof, as illustrated in FIG. 9.

As seen in FIGS. 5, 9 and 10, laterally spaced-apart ribs 70 extend from the undersurface of the lip 14 inwardly of the frame-shaped rim 12 to assist in positioning the photograph within the display frame F'.

What is claimed is:

1. A display frame for displaying a sheet-like article, comprising attachment means for retaining the article on said display frame, viewing means for allowing at least part of the article to be viewed when mounted to said display frame, and at least one support stand pivotally connected to a rear wall of said display frame along a first pivot axis, said support stand being reversibly pivotable between an inoperative retracted position wherein said support stand is substantially parallel to said rear wall and an operative extended stand position wherein said support stand extends at an angle with respect to said rear wall for allowing said display frame to be supported on a substantially horizontal support surface, said support stand having locking means adapted upon pivot of said support stand from said inoperative retracted position to said operative extended stand position thereof to displace relative to said first pivot axis, wherein in said operative extended stand position, said locking means are resiliently biased against one of said rear wall and said sheet-like article to retain said support stand in said operative extended stand position.

2. A display frame as defined in claim 1, wherein said locking means is pivotally displaceable about a second pivot axis which is, in turn, pivotally displaceable with respect to said first pivot axis and wherein said support stand is spring loaded at said first and second pivot axes.

3. A display frame as defined in claim 2, wherein said support stand includes a proximal end portion which pivots about said first pivot axis, and a distal end portion pivotally mounted to said proximal end portion for allowing said distal end portion to be folded away from said rear wall to engage the horizontal support surface, said locking means extending from said distal end portion to an opposite side of said second pivot axis so that upon pivotal movement of said distal end portion about said second pivot axis in a direction away from said rear wall, said locking means is automatically urged against one of said rear wall and said sheet-like article.

4. A display frame as defined in claim 1, wherein said support stand is formed by a cutout configuration defined in said rear wall, whereby said support stand is disposed in the plane of said rear wall when displaced to said inoperative retracted position thereof, and whereby said locking means contact said sheet-like article when said support stand is pivoted to said operative extended stand position thereof.

5. A display frame as defined in claim 1, wherein at least a pair of said support stands are symmetrically disposed with respect to a median axis of said display frame for allowing a selected one of said support stand to support said display frame onto the substantially horizontal support surface in a first orientation of said display frame, and for allowing both said support stands to be displaced to said operative extended stand position thereof such that said display frame may be disposed on the substantially horizontal support surface in a second orientation rotated by 90 degrees with respect to said first orientation.

* * * * *